US008276617B2

(12) United States Patent
Cai et al.

(10) Patent No.: US 8,276,617 B2
(45) Date of Patent: Oct. 2, 2012

(54) PISTON VALVE FOR DIAPHRAGM PUMP

(76) Inventors: Ying Lin Cai, Guangdong (CN); Chao Fou Hsu, Kaohsiung (TW)

( * ) Notice: Subject to any disclaimer, the term of this patent is extended or adjusted under 35 U.S.C. 154(b) by 320 days.

(21) Appl. No.: 12/461,174

(22) Filed: Aug. 4, 2009

(65) Prior Publication Data

US 2010/0025614 A1 Feb. 4, 2010

Related U.S. Application Data

(60) Provisional application No. 61/129,973, filed on Aug. 4, 2008.

(51) Int. Cl.
*F16K 15/14* (2006.01)

(52) U.S. Cl. ..... 137/854; 417/569

(58) Field of Classification Search ..... 137/843, 137/854; 417/569
See application file for complete search history.

(56) References Cited

U.S. PATENT DOCUMENTS 5,173,033 A * 12/1992 Adahan ..... 417/234
6,048,183 A * 4/2000 Meza ..... 417/569
2006/0090642 A1 5/2006 Hsu et al.

* cited by examiner

*Primary Examiner* — Kevin Lee
*Assistant Examiner* — MaCade Brown
(74) *Attorney, Agent, or Firm* — Bacon & Thomas, PLLC

(57) ABSTRACT

A piston valve for improving the output efficiency of a diaphragm pump includes a central discharge base and a plurality of water inlet ports, wherein each of the discharge base and water inlet ports is provided with a top concave surface, and a plastic gasket is engaged with the concave surface of the water discharge base and a piston slice is engaged with the concave surface of each water inlet port so that a gap is defined between the gasket and its concave surface and a gap is also defined between each piston slice and its corresponding concave surface.

2 Claims, 12 Drawing Sheets

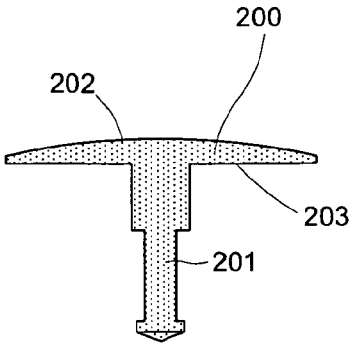
FIG.14a
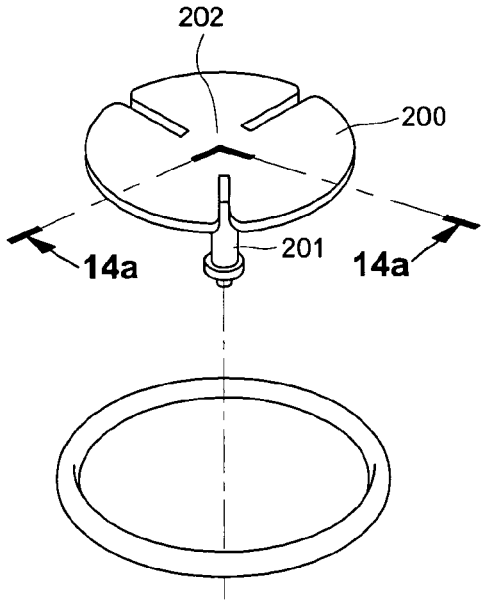
FIG.14
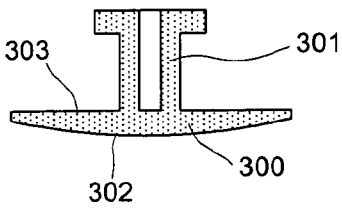
FIG.14b
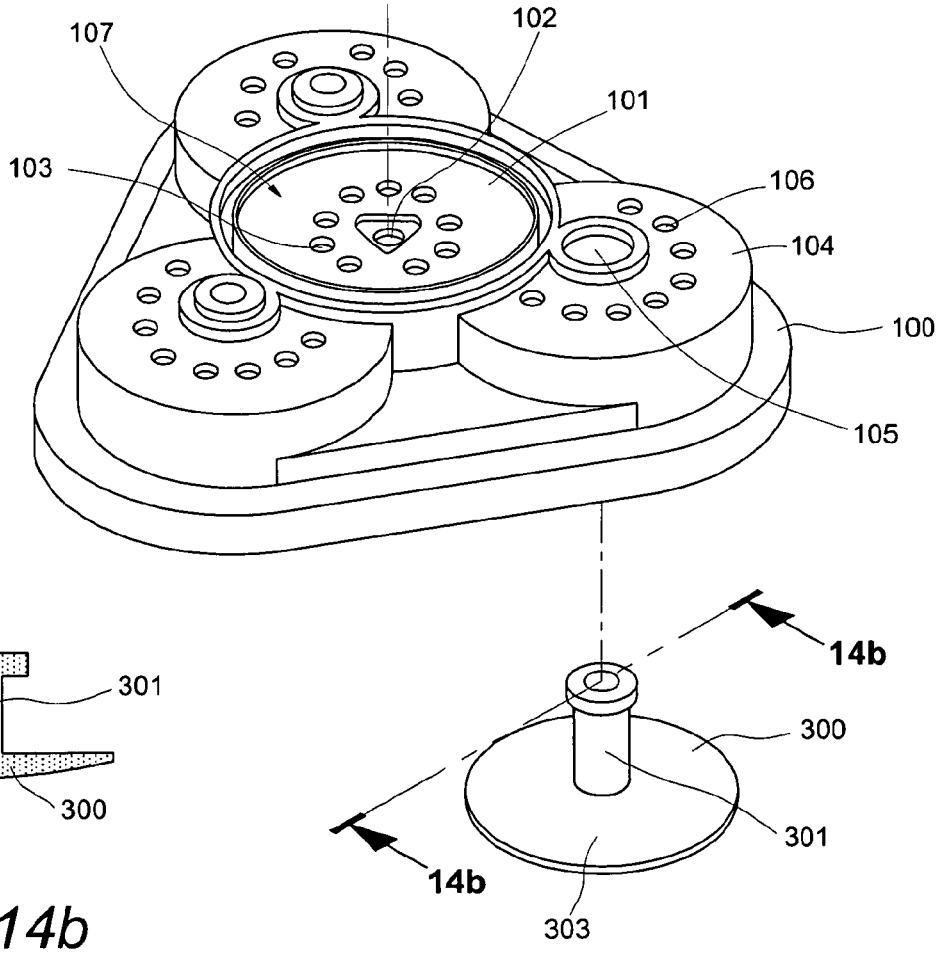

PISTON VALVE FOR DIAPHRAGM PUMP

This application claims the benefit of provisional U.S. Patent Application No. 61/129,973, field Aug. 4, 2008.

FIELD OF THE PRESENT INVENTION

The present invention relates to an improved piston valve for improving the compressing output efficiency in the diaphragm pump, which is exclusively used in the reverse osmosis purification, particularly for one that prevent the abnormal pressure and decreasing compressing efficiency.

BACKGROUND OF THE INVENTION

As shown in the FIGS. 1 though 6, which are the various views pertaining to a diaphragm pump 1 of the prior art for the conventional water filter of Reverse-Osmosis (RO) type. The diaphragm pump 1 comprises a motor 10, an upper hood chassis 11, plural wobble wheels 13, a diaphragm 20, a piston valve 30, a hemisphere-shaped bowl anti-backflow plastic gasket 40 and an upper hood 50, wherein said hood chassis 11, which is disposed on the output shaft of the motor 10 (not shown in the figures), has plural screw bores 12 evenly disposed around the peripheral thereof, said wobble wheels 13, which are disposed on the top surface of the upper hood chassis 11, are driven by the output shaft of the motor 10 in rotatable manner to be converted into axial reciprocal movement, said diaphragm 20, which is disposed over the upper hood chassis 11, has the piston valve 30 inset thereon, said anti-backflow plastic gasket 40 is closely attached on the piston valve 30 centrally, and said upper hood 50 has plural perforated bores 51 evenly disposed around the peripheral thereof in corresponding with the screw bores 12 on the upper hood chassis 11 such that the upper hood chassis 11 and upper hood 50 can be compactly docked each other with foregoing diaphragm 20, piston valve 30 and anti-backflow plastic gasket 40 being orderly interposed therebetween by running bolts 2 through aligned screw bores 12 and corresponding perforated bores 51 preset respectively (as shown in the FIG. 6);

Furthermore, wherein: Said diaphragm 20 has a gasket groove 21 configured on the peripheral edge, plural convex humps 22, each of which is stacked with an associating eccentric piston pushers 23 disposed thereon, such that each of convex humps 22 and associating piston pusher 23 has a central coaxial perforated bore 221, 231 created therein for being run through by a screw 24 to screw the diaphragm 20 and each corresponding piston pusher 23 on each corresponding wobble wheel 13 (as shown in the FIG. 6); thereby, the diaphragm 20 and the piston pushers 23 can be simultaneously driven by the wobble wheels 13 to axially move in reciprocal displacement (as shown by the hypothetical dash line in the FIG. 6);

As shown in the FIGS. 2 and 4 though 6, said piston valve 30 has a hemisphere-shaped bowl water discharge base 31 with an orientating hole 32 centrally concaved therein, three separating grooves 33 are evenly created on top surface thereof in radial way to form three equivalent sector areas between adjacent separating grooves 33 in each included angle of almost 120° with the orientating hole 32 as center such that plural water discharge spouts 34 are configured in each sector area, and three inversed flare piston slices 36 are evenly disposed at suitable positions outside of the peripheral of the central water discharge base 31 near each corresponding sector area respectively for blocking associated plural water inlet slots 35, which are created therein; Said bowl anti-backflow plastic gasket 40, which is unitarily one-piece molded hollow hemisphere made of soft flexible material and being closely attached on the piston valve 30 centrally, has an orientating stem 41 protruded beneath the bottom side thereof and three separating rib panels 42 with each extending projecting panel 43 are evenly disposed on top surface thereof in radial way to form a hollow hemisphere-shaped bowl with three equivalent inner sector cambers between adjacent separating rib panels 42 in each included angle of almost 120° with the orientating stem 41 as center such that each projecting panel 43 is protruded outside of the hollow hemisphere-shaped bowl as extender of each corresponding separating rib panels 42; By alignment of each projecting panel 43 of the anti-backflow plastic gasket 40 with corresponding each separating grooves 33 of the water discharge base 31, inserting the orientating stem 41 into the corresponding orientating hole 32, the anti-backflow plastic gasket 40 and water discharge base 31 can be properly docked each other so that the outer hemisphere of the anti-backflow plastic gasket 40 can closely attach over the top surface of the water discharge base 31 and each of three equivalent inner sector cambers thereof will totally block all the corresponding water discharge spouts 34 on the water discharge base 31 during rest mode of the compressing diaphragm pump (as shown in the FIG. 4); Thereby, a preliminary low-pressured chamber 3 is created between each piston pusher 23 of the diaphragm 20 and the water discharge spouts 34 of the anti-backflow plastic gasket 40, which is closely attached by the piston valve 30 after docking such that one end thereof is connected with the water inlet slots 35 of the piston valve 30 (as shown in the FIG. 6); and Said upper hood 50 has a water inlet orifice 52 and a water outlet orifice 53 configured on the outer surface thereof as well as plural perforated bores 51 disposed over the outer rim thereof (as shown in the FIGS. 1 and 6), a ramp groove 54 disposed beneath at the inner bottom rim so that the outer rim on the integral stacked unit of the piston valve 30 and diaphragm 20 can hermetically engage with the ramp groove 54 in compatible manner; Besides, an annular groove 55 is centrally disposed at the top inner wall of said upper hood 50 such that the bottom rim thereof hermetically attach the outer rim of the water discharge base 31 on the piston valve 30, thereby an intensive high-pressured chamber 4 is formed among the annular groove 55 and water discharge base 31 (as shown in the FIG. 6).

For functional operation, please refer to the FIG. 7. Firstly, as the diaphragm 20 is axially pushed by the reciprocal movement of the wobble wheels 13 alternately during operation mode of the diaphragm pump 1, the tap water W, which flows into the upper hood 50 from the water inlet orifice 52, is run into the preliminary low-pressured chamber 3 via the water inlet slots 35 of the piston valve 30 (as shown by the arrowhead in the FIG. 7), where the pressure of the tap water W is pumped up to range of 80 psi~100 psi by the repeated compression of the piston pusher 23, which is acted by the axial reciprocal movement of the wobble wheels 13; Secondly, the tap water W in the low-pressured chamber 3 is pumped to the intensive high-pressured chamber 4 via the water discharge spouts 34 of the water discharge base 31, where the pressure of the tap water W is pumped up to desired range preset; and Finally, the tap water W in the high-pressured chamber 4 is pumped out of the diaphragm pump 1 via the water outlet orifice 53 of the water upper hood 50 to flow into a filter cartridge for the conventional water filter of Reverse-Osmosis (RO) type (which is not shown in the figures). As described above, during rest mode of the diaphragm pump 1, the hemisphere-shaped bowl anti-backflow plastic gasket 40 closely attaches over the top surface of the water discharge base 31 of the piston valve 30 and each of three equivalent inner sector cambers thereof will totally block all the corresponding water discharge spouts 34 on the water discharge base 31; Whereas, during operation mode of the diaphragm pump 1, each of the three equivalent inner sector cambers of the anti-backflow plastic gasket 40 is activated by the water discharge spouts 34 covered thereof to repeat a kind of pump reaction in open-and-close manner by orderly turns. Because the anti-backflow plastic gasket 40 is unitarily one-piece molded from soft flexible material, each rest inner sector camber is easily susceptible to the interlinking action by the adjacent acting inner sector camber into ajar status so that the corresponding water discharge spouts 34 covered by the rest inner sector camber become ajar instead of completely being blocked, which is ideal open-and-close effect expected originally. Especially, the deformation δ of the anti-backflow plastic gasket 40 will get worse (as shown in the FIG. 3) after service for a period of time due to aging effect of the material. Thereby, the overall effect in the discharging quantity and pressure of the output pressured water will be decreased in consequence of losing completely blocking function for the water discharge spouts 34. That is the primary cause that the phenomena of the "abnormal pressure" and "decrease in the output quantity of the pressured water" will happen if the diaphragm pump 1 of prior art in the conventional water filter of Reverse-Osmosis (RO) type has been used for about 3 to 6 months.

For the purpose of improving the foregoing drawbacks, the inventor of the present invention via research worked out a concrete solving scheme by contriving an improved compressing diaphragm pump, which was submitted to the USA at Oct. 24 and 26 in 2006 for patent application with Filing Ser. No. 11/258,027, and to Korea for patent application with Filing Number 10-2006-0103513. The structure of the improved diaphragm pump is as shown in the FIGS. 8 though 12 with component revision primarily for the water discharge base 61 that from the previous hemisphere-shaped bowl water discharge base 31 is revised into following planar water discharge base 61, which is centrally located in the piston valve 60 of the diaphragm pump 1 in facing upwards to the upper hood 50. Accordingly, all the associated components of the revised water discharge base 61 are somewhat modified as below. Where in the water discharge base 61, an orientating lump 62 with a central orientating hole 63 is centrally concaved in the top surface thereof, three equivalent sector areas are evenly formed on top surface thereof in radial way in each included angle of almost 120° with the orientating hole 63 as center such that plural water discharge spouts 64 are configured in each sector area, and three inversed flare piston slices 36 are evenly disposed at suitable positions outside of the peripheral of the central water discharge base 61 near each corresponding sector area respectively for blocking associated plural water inlet slots 65, which are created therein; Moreover, component revision for the anti-backflow plastic gasket 70 is that from the previous hemisphere-shaped bowl anti-backflow plastic gasket 40 is revised into following planar multi-blade disk-shaped anti-backflow plastic gasket 70 with three separating rifts 71 are evenly disposed thereat in radial way to form three equivalent inner sector blades between adjacent separating rifts 71 in each included angle of almost 120° with an orientating aperture 72, which is punched through in the center thereof with an orientating rim 73 protruded beneath, as center such that each of three equivalent inner sector blades thereof will totally block all the corresponding water discharge spouts 64 on the water discharge base 61 during rest mode of the diaphragm pump; For assembly, please refer to the FIGS. 9 and 10. Firstly, sleeve the orientating aperture 72 of the anti-backflow plastic gasket 70 onto the central orientating lump 62 of the water discharge base 61 by facing the orientating rim 73 towards the water discharge base 61; and Secondly, insert a T-shaped orientating stem 80 into the orientating hole 63 in the orientating lump 62 via the orientating aperture 72 in the anti-backflow plastic gasket 70 so that the anti-backflow plastic gasket 70 is securely anchored in the water discharge base 61.

For functional operation, please refer to the FIGS. 11 and 12. Firstly, as the diaphragm 20 is axially pushed by the reciprocal movement of the wobble wheels 13 alternately during operation mode of the compressing diaphragm pump 1, the tap water W, which flows into the upper hood 50 from the water inlet orifice 52, is run into the preliminary low-pressured chamber 3 via the water inlet slots 65 of the piston valve 60 (as shown by the arrowhead in the FIG. 11), where the pressure of the tap water W is pumped up to range of 80 psi~100 psi by the repeated compression of the piston pusher 23, which is acted by the axial reciprocal movement of the wobble wheels 13; Secondly, the tap water W in the low-pressured chamber 3 is pumped by pushing up each sector blade of the anti-backflow plastic gasket 70 alternately to the intensive high-pressured chamber 4 via the water discharge spouts 64 of the water discharge base 61 (as shown by the arrowhead in the FIG. 12), where the pressure of the tap water W is pumped up to desired range preset; and Finally, the tap water W in the high-pressured chamber 4 is pumped out of the compressing diaphragm pump 1 via the water outlet orifice 53 of the water upper hood 50 (as shown in the FIG. 12). Thus, all the tap water W coming from all the water inlet slots 65 will constantly flow through the water discharge spouts 64 in the water discharge base 61 alternately to activate each sector blade of the anti-backflow plastic gasket 70 in alternate "up-open and down-close" manner so that the effect in completely open-and-close water discharge spouts 64 in all sector areas is truly achieved. Therefore, not only the drawbacks in the "abnormal pressure" and "decrease in the output quantity of the pressured water" can be solved, but also the serving life span of the anti-backflow plastic gasket 70 can be increased.

Although the improving revision for the structure of the piston valve 60 and anti-backflow plastic gasket 70 can really achieve the effect sin "reducing the abnormal pressure" and "increasing the output quantity of the pressured water" after practical molding and testing to certain degree, the inventor of the present invention does not satisfy with the fruitful result. The inventor of the present invention believes that there must be certain feasible scheme to improve the overall compressing effect in better way for the diaphragm pump 1.

SUMMARY OF THE INVENTION

The primary object of the present invention is to provide an "improved piston valve for diaphragm pump" comprises a water discharge base, which is centrally disposed in the piston valve, and a anti-backflow plastic gasket, which is centrally inserted in the water discharge base, as well as plural water inlet port, which are respectively disposed at a suitable position outside of the piston valve, and plural piston slice, which are respectively disposed beneath each corresponding water inlet port, wherein the features are that the top surface of said water discharge base is contrived into a camber concave with the center of the orientating hole as lowest point, and the top surface of each said water inlet port, where each said water inlet port contacts with each corresponding piston slice, is also contrived into a camber concave with the center of the orientating hole as lowest point; Said anti-backflow plastic gasket with an associated orientating stem is made of soft elastic material by unitarily one-piece molding into an integral single unit such that the bottom surface thereof becomes a planar surface, and each said piston slice with an associated orientating stem is also made by unitarily one-piece molding into an integral single unit such that the bottom surface thereof becomes a planar surface; Thereby, after anchoring the anti-backflow plastic gasket into the water discharge base properly, a gap is formed between the bottom surface of the anti-backflow plastic gasket and the top camber concave surface of the water discharge base; Likewise, after anchoring each piston slice into each corresponding water inlet port properly, a gap is formed between the bottom surface of the piston slice and the top camber concave surface of the water inlet port. By means of the functions of foregoing gaps, the overall compressing efficiency is substantially enhanced because both the sucking forces of the anti-backflow plastic gasket and piston slice are further increased by the reciprocal actions of the piston pusher.

Another object of the present invention is to provide an "improved piston valve for diaphragm pump" wherein both of said anti-backflow plastic gasket and each said piston slice are contrived into a plano-convex shape so that not only the durability thereof can be improved but also the effects of hermetical attachment onto the corresponding water discharge holes and water inlet holes can be achieved; Thus, the "abnormal pressure" issue in the piston valve of the conventional diaphragm pump is completely solved by the present invention.

The other object of the present invention is to provide an "improved piston valve for diaphragm pump" wherein said anti-backflow plastic gasket in the piston valve is made by unitarily one-piece molding into an integral single unit, the assembly procedure for the present invention is much quicker and much more time-saving than that of the conventional diaphragm pump so that the labor cost in the fabrication can be significantly reduced; Thus, for mass production of the diaphragm pump, the present invention offers better competitiveness in the economic effect of the mass production.

BRIEF DESCRIPTION OF THE DRAWINGS

FIG. 14 is an exploded perspective view of the present invention.

FIG. 14*a* is a sectional view taken along the line 14*a*-14*a* of the FIG. 14.

FIG. 14*b* is a sectional view taken along the line 14*b*-14*b* of the FIG. 14.

DETAILED DESCRIPTION OF THE PREFERRED EMBODIMENTS

Figure 1:
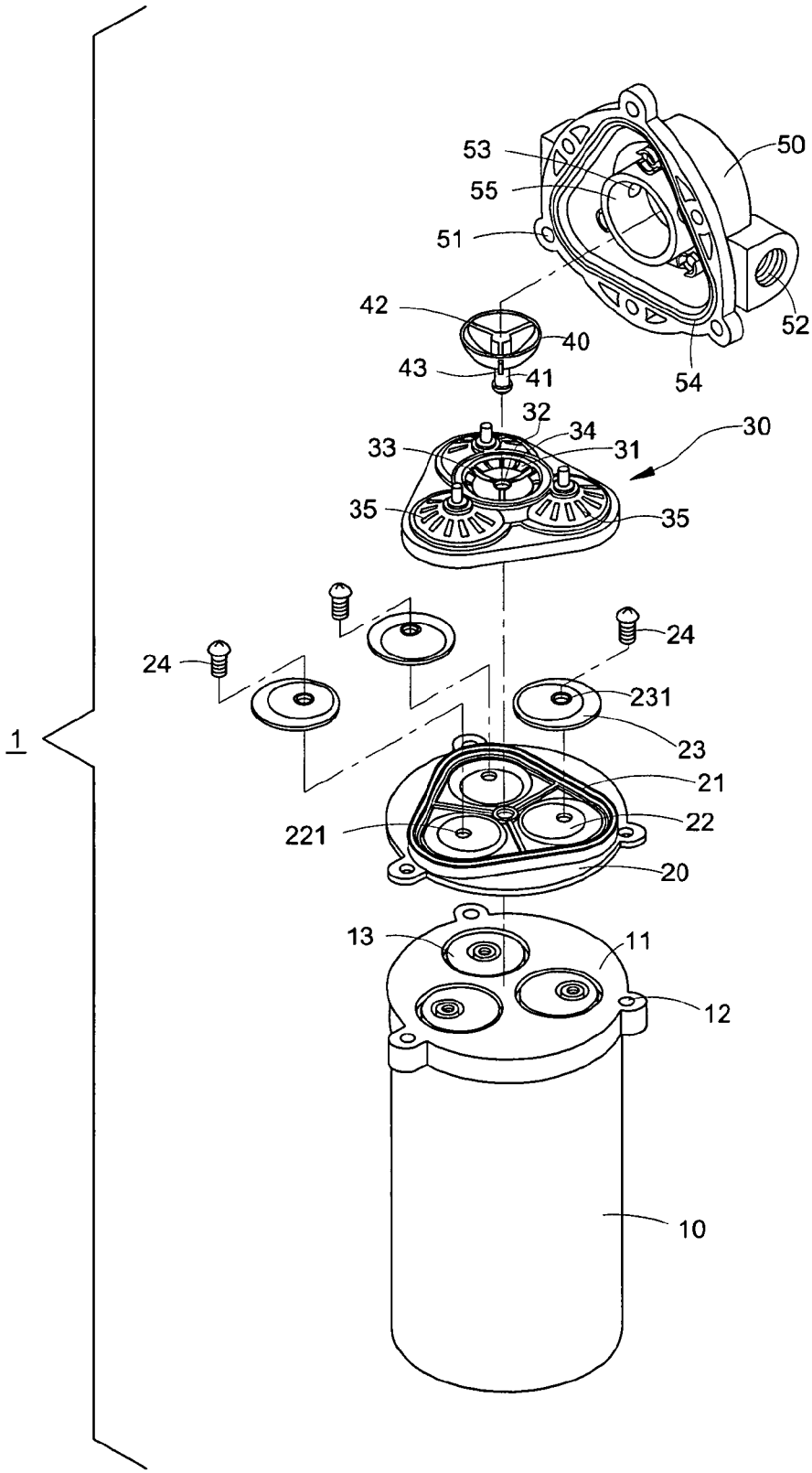
FIG.1 (PRIOR ART)
FIG. 1 is a exploded perspective view showing the conventional diaphragm pump of the prior art.
Figure 2:
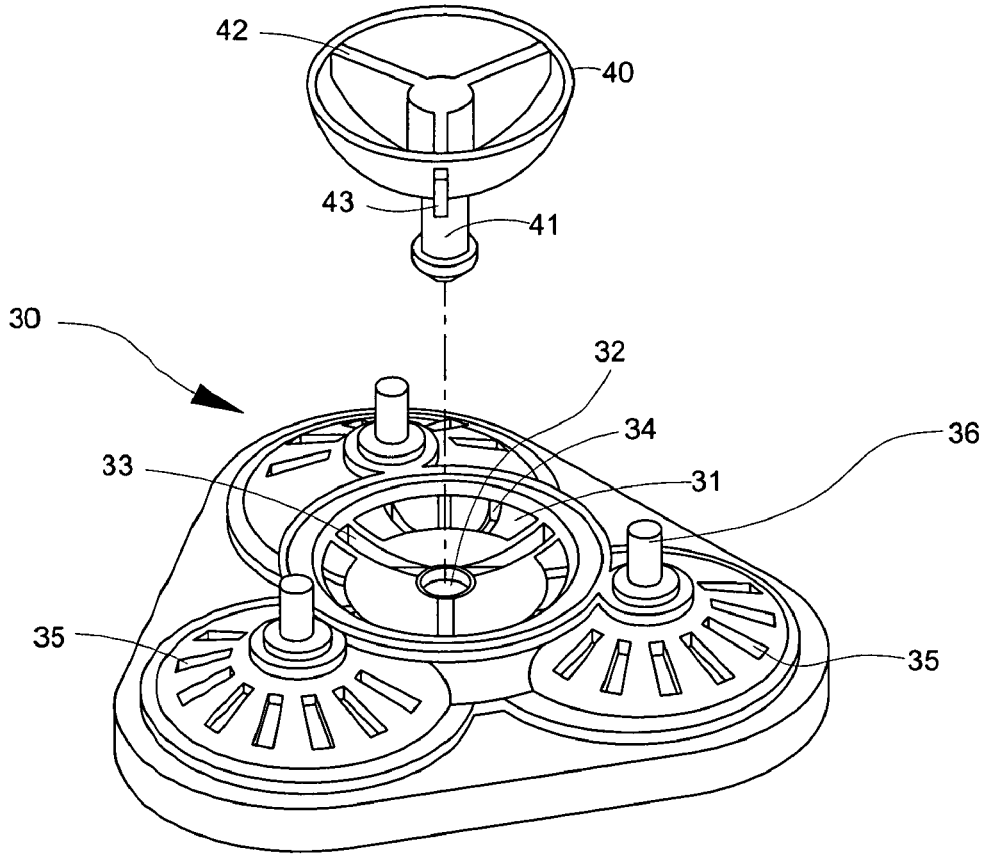
FIG.2 (PRIOR ART)
FIG. 2 is a perspective schematic view showing the conventional piston valve and anti-backflow plastic gasket of the prior art.
Figure 3:
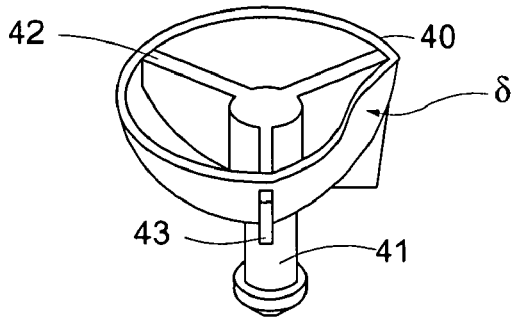
FIG.3 (PRIOR ART)
FIG. 3 is a perspective schematic view showing the deformation of the anti-backflow plastic gasket in the prior art.
Figure 4:
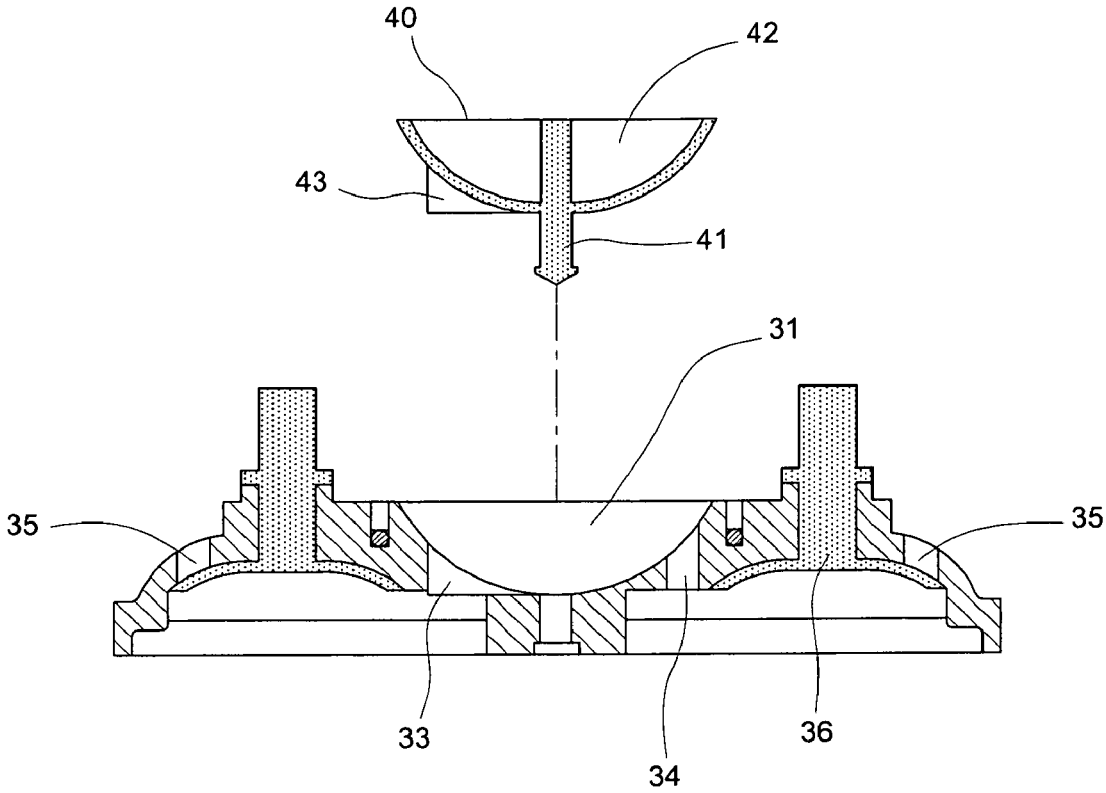
FIG.4 (PRIOR ART)
FIG. 4 is a sectional view showing the disassembly of the conventional piston valve and anti-backflow plastic gasket for the prior art.
Figure 5:
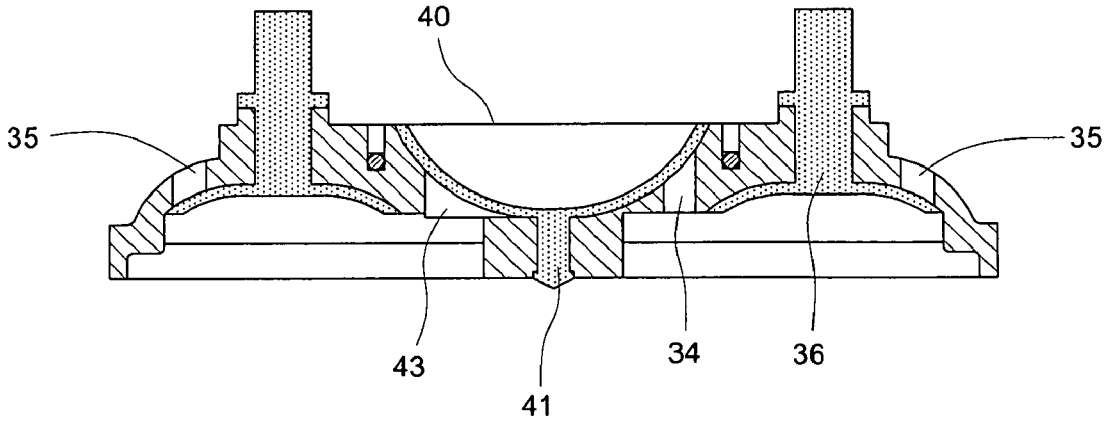
FIG.5 (PRIOR ART)
FIG. 5 is a sectional view showing the assembly of the conventional piston valve and anti-backflow plastic gasket for the prior art.
Figure 6:
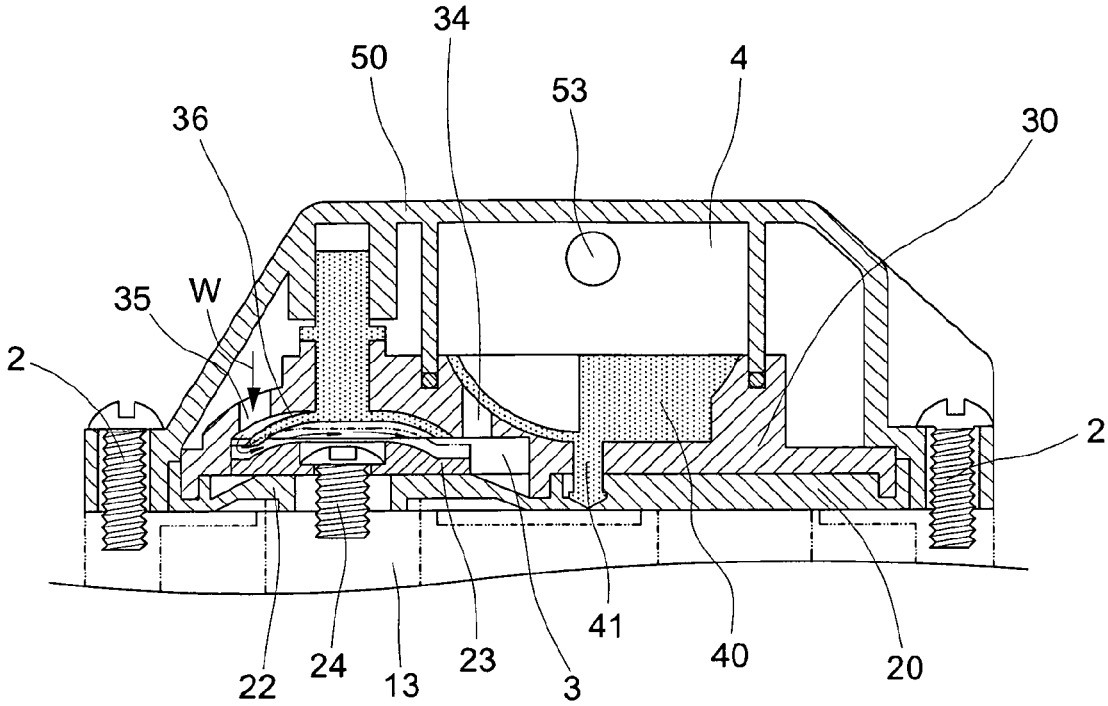
FIG.6 (PRIOR ART)
FIG. 6 is a partial sectional view showing the assembly of the conventional piston valve and upper hood for the prior art.
Figure 7:
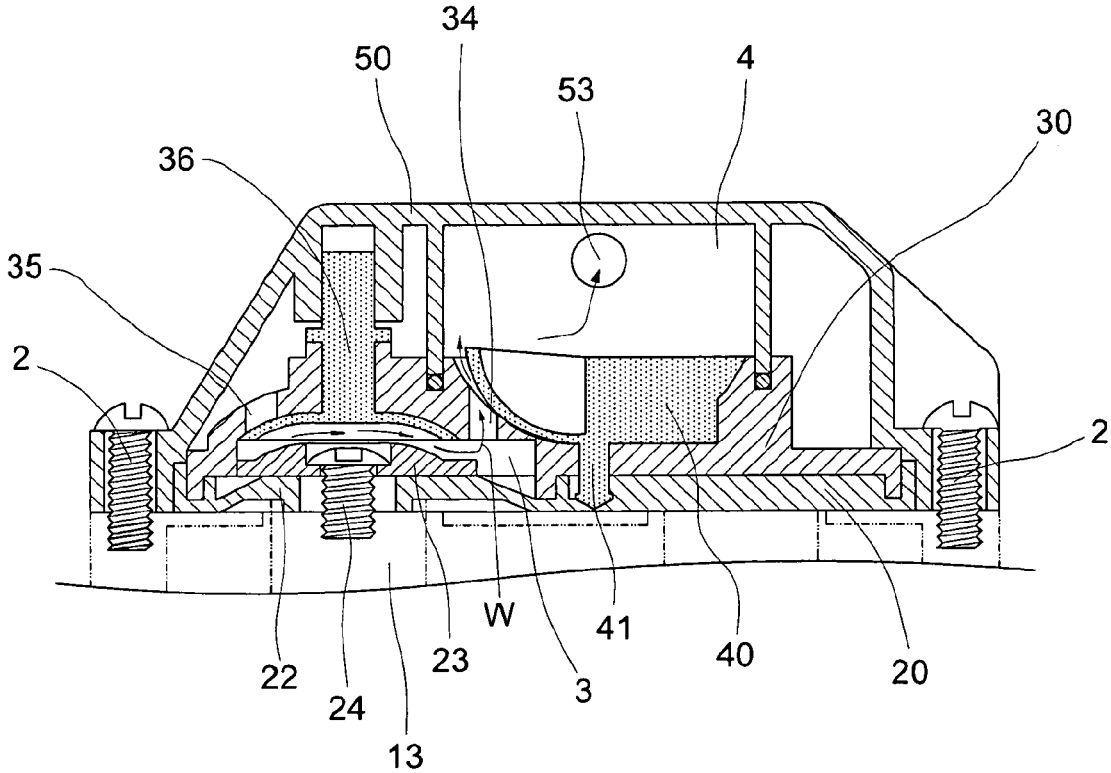
FIG.7 (PRIOR ART)
FIG. 7 is an operational view of the FIG. 6.
Figure 8:
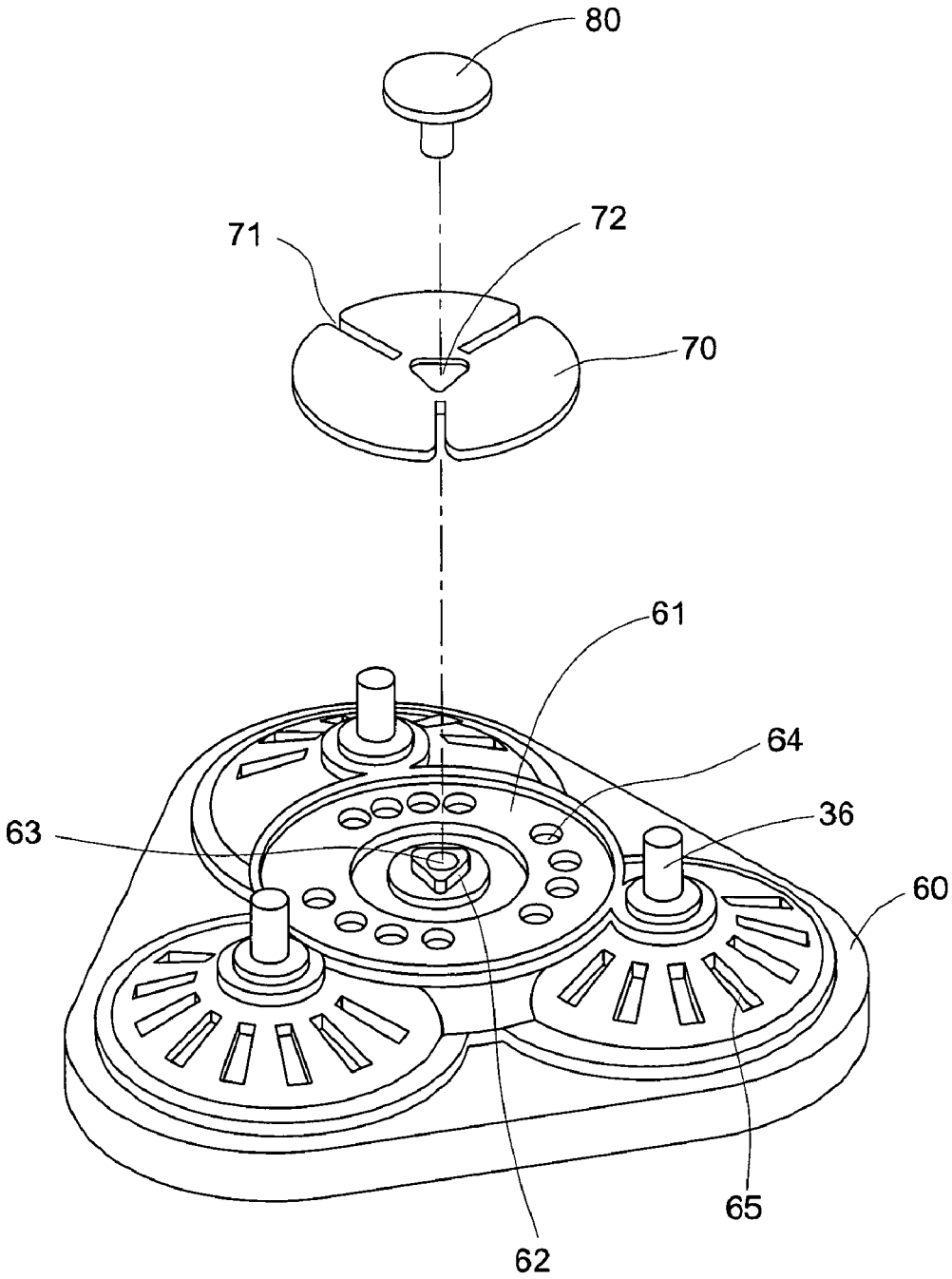
FIG.8 (PRIOR ART)
FIG. 8 is an exploded perspective view showing the conventional piston valve and anti-backflow plastic gasket of another prior art.
Figure 9:
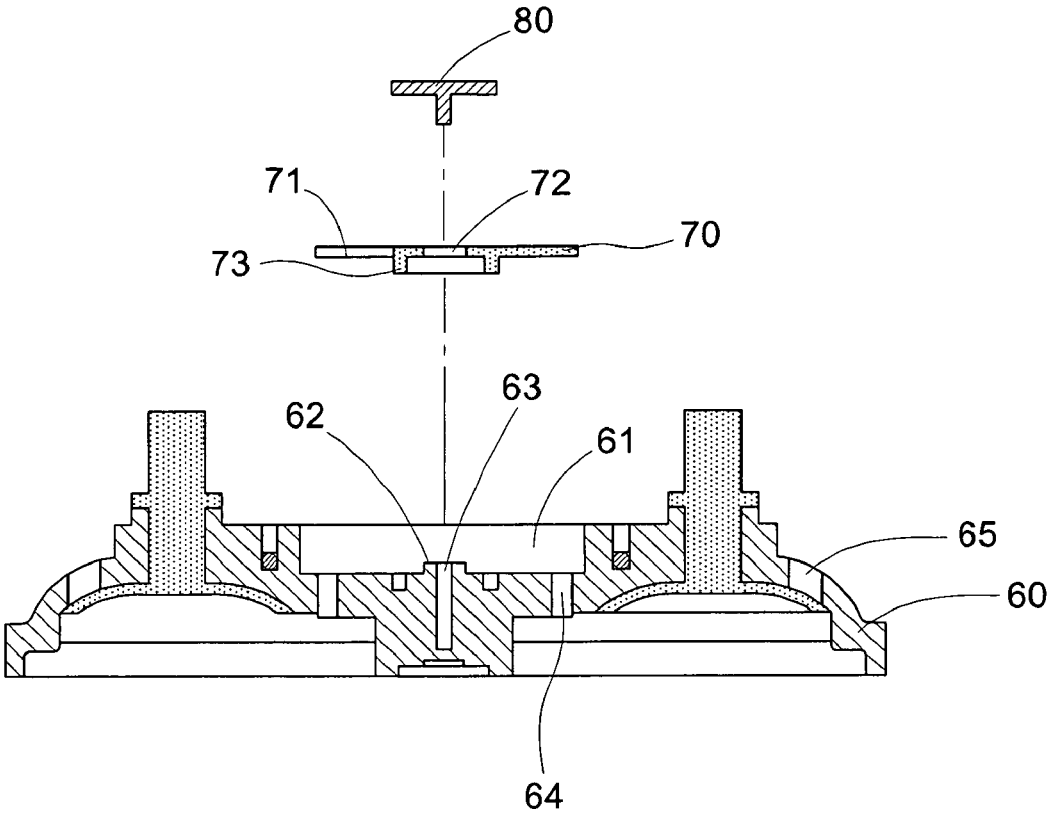
FIG.9 (PRIOR ART)
FIG. 9 is a sectional view showing the disassembly of the conventional piston valve and anti-backflow plastic gasket for another prior art.
Figure 10:
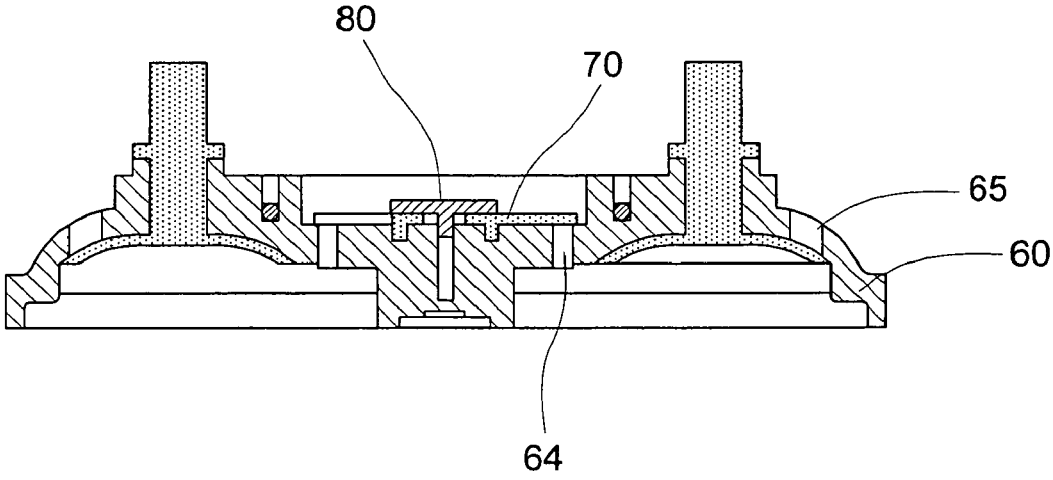
FIG.10 (PRIOR ART)
FIG. 10 is a sectional view showing the assembly of the conventional piston valve and anti-backflow plastic gasket for another prior art.
Figure 11:
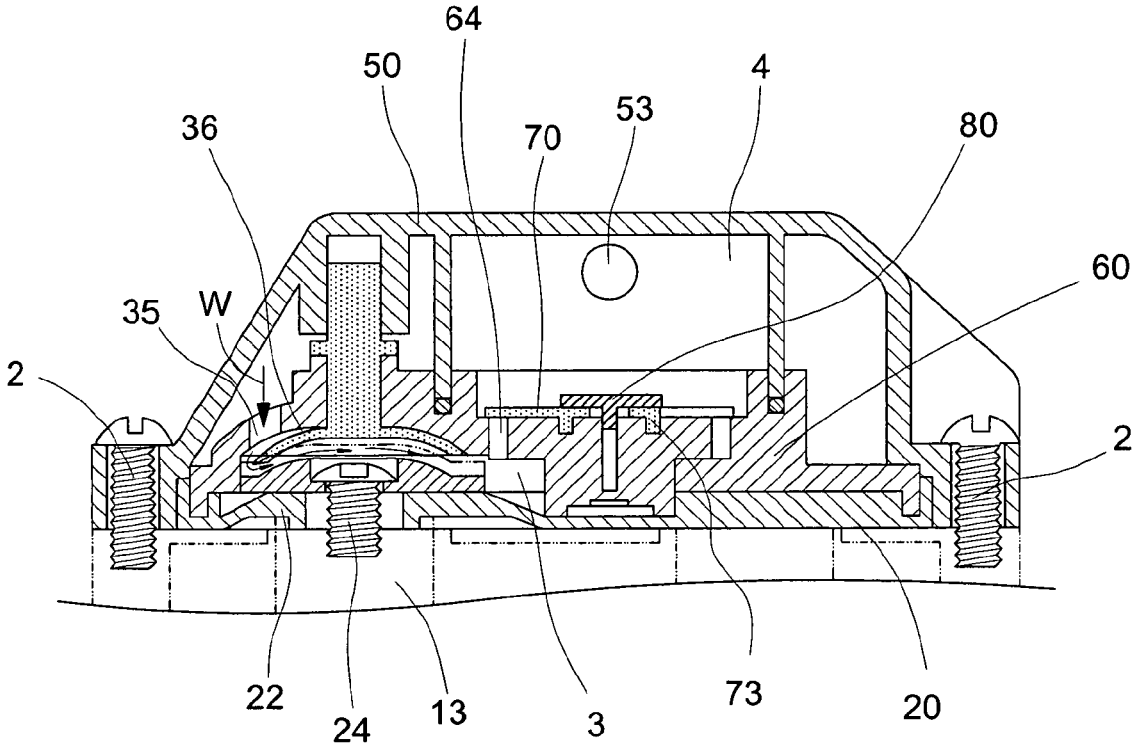
FIG.11 (PRIOR ART)
FIG. 11 is a partial sectional view showing the assembly of the conventional piston valve, anti-backflow plastic gasket and upper hood for another prior art.
Figure 12:
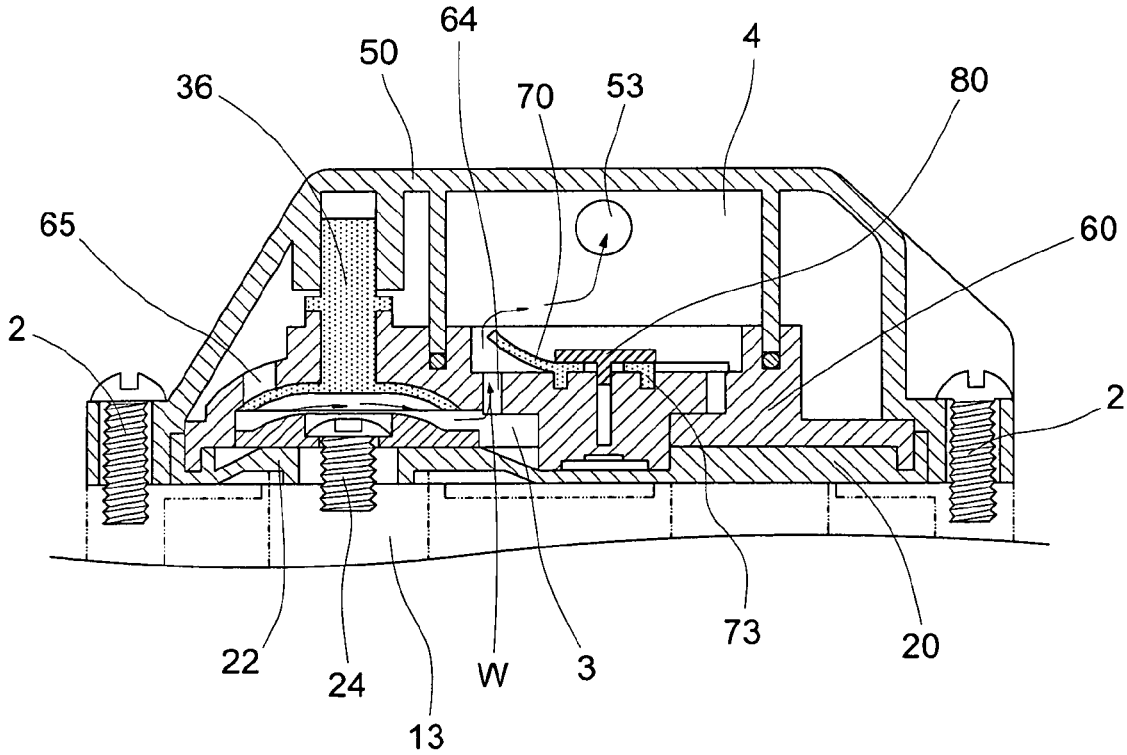
FIG.12 (PRIOR ART)
FIG. 12 is an operational view of the FIG. 11.
Figure 13:
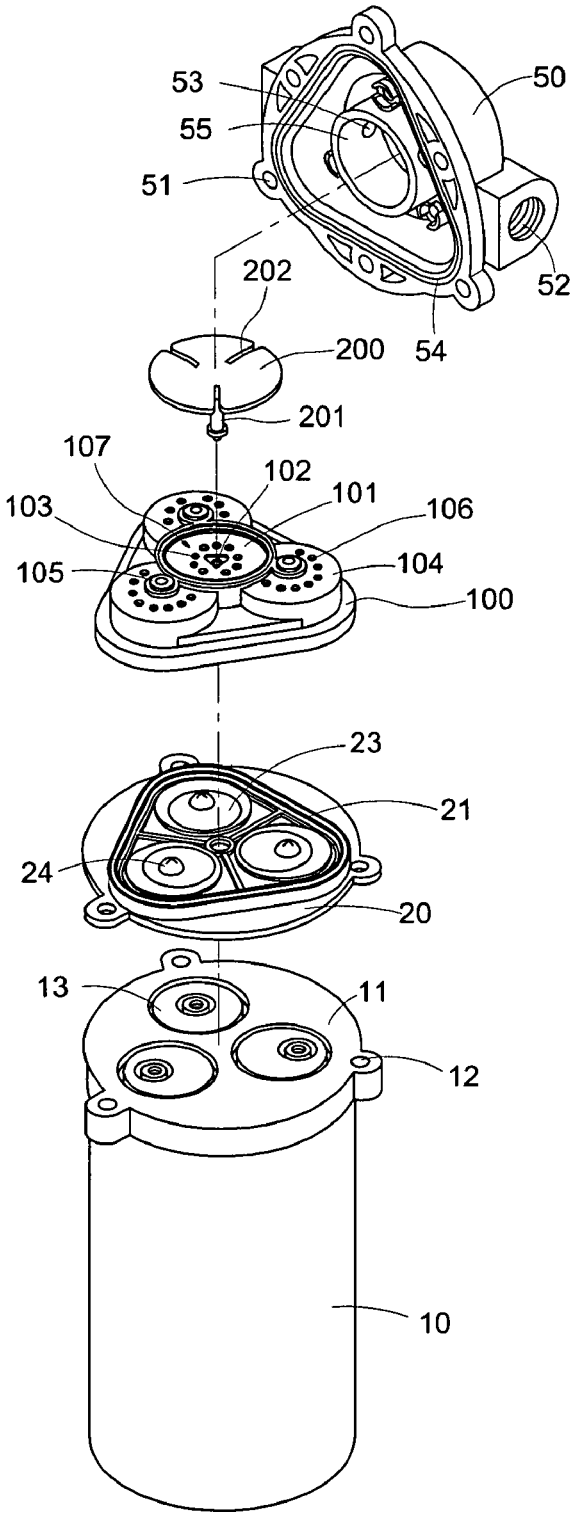
FIG. 13 is an exploded perspective schematic view showing the improved piston valve of the present invention and conventional diaphragm pump of the prior art.

Please refer to the FIGS. 13 though 16, which are the various views about the "improved piston valve for diaphragm pump" of the present invention. As the improved piston valve 100 is revised from the conventional piston valve 30, so all the associated components of the improved piston valve 100 are somewhat modified as below: a water discharge base 101 is revised from the corresponding conventional water discharge base 31, an orientating hole 102 is revised from the corresponding conventional orientating hole 32, a water discharge holes 103 is revised from the corresponding conventional water discharge spouts 34, a water inlet port 104 is revised from an integral holding unit for all conventional water discharge spouts 34, a orientating hole 105 is revised from a holding hole for the conventional flare piston slice 36, a water inlet holes 106 is revised from the conventional water inlet slots 35; Wherein said water discharge base 101 has a camber concave 107 of outer top surface with the center of the orientating hole 102 as lowest point disposed thereon (as shown in the FIGS. 14 and 15), and each said water inlet port 104 has a camber concave 108 of outer top surface with the center of the orientating hole 105 as lowest point disposed, where each said water inlet port 104 contacts with each corresponding piston slice 300 (as shown in the FIG. 15); Besides, a plano-convex shaped anti-backflow plastic gasket 200, which is revised from the corresponding conventional hemisphere-shaped bowl anti-backflow plastic gasket 40, and an associated orientating stem 201 are made of soft elastic material by unitarily one-piece molding into an integral single unit, and centrally disposed in the water discharge base 101 of the piston valve 100 (as shown in the FIG. 14*a*) such that the top surface 202 of the anti-backflow plastic gasket 200 becomes a camber convex and the bottom surface 203 of the anti-backflow plastic gasket 200 becomes a planar surface and results in thickness t1 is larger than thickness t2, where the t1 denotes the thickness measured from the central top point of the top surface 202 to the bottom surface 203 and t2 denotes the thickness measured from the top edge of the top surface 202 to the bottom surface 203 (as shown in the FIG.

Figure 15:
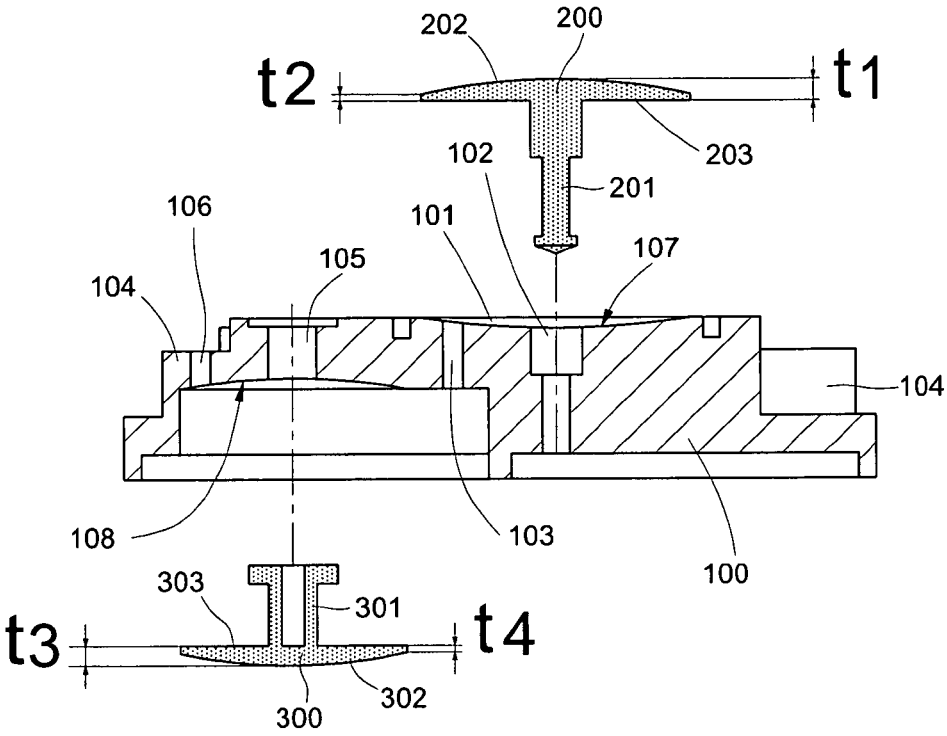
FIG. 15 is an exploded sectional view of the present invention.

15); and A plano-convex shaped piston slice 300, which is revised from the conventional flare piston slice 36, and an associated orientating stem 301 are made by unitarily one-piece molding as an integral unit, and centrally disposed in each water inlet port 104 of the piston valve 100(as shown in the FIG. 14*b*) such that the top surface 302 of the piston slice 300 becomes an camber convex and the bottom surface 303 of the piston slice 300 becomes a planar surface and results in thickness t3 is larger than thickness t4, where the t3 denotes the thickness measured from the central top point of the top surface 302 to the bottom surface 303 and t4 denotes the thickness measured from the top edge of the top surface 302 to the bottom surface 303 (as shown in the FIG. 15).

Figure 16:
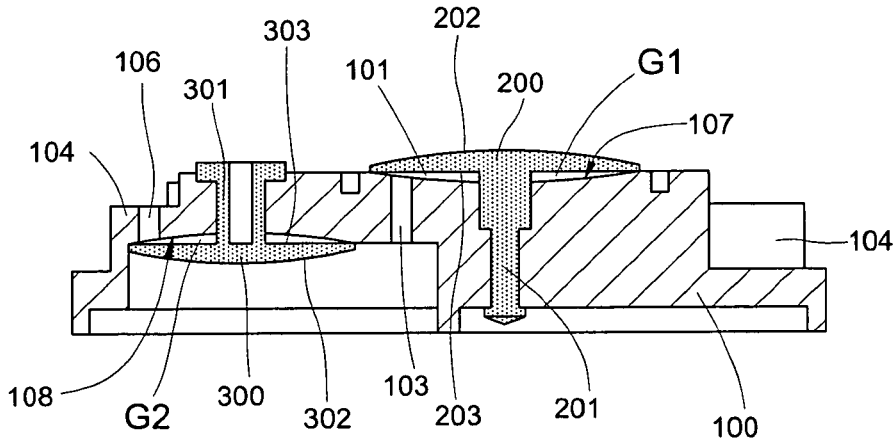
FIG. 16 is an assembly sectional view of the present invention.
Figure 17:
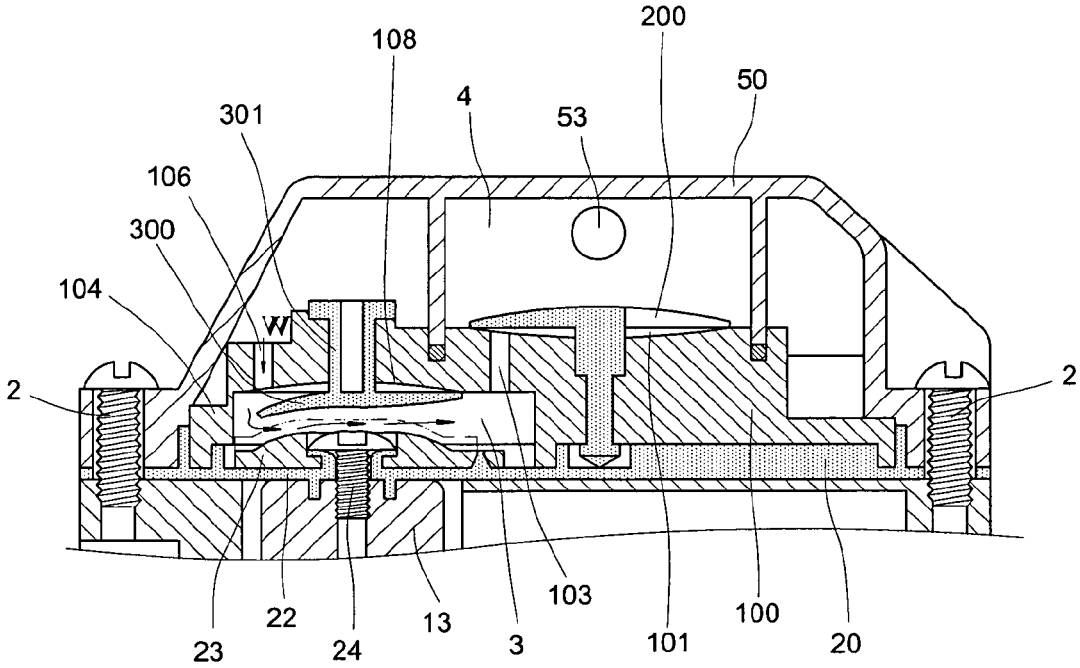
FIG. 17 is a partial sectional view showing the assembly of the present invention and conventional upper hood of the prior art.
Figure 18:
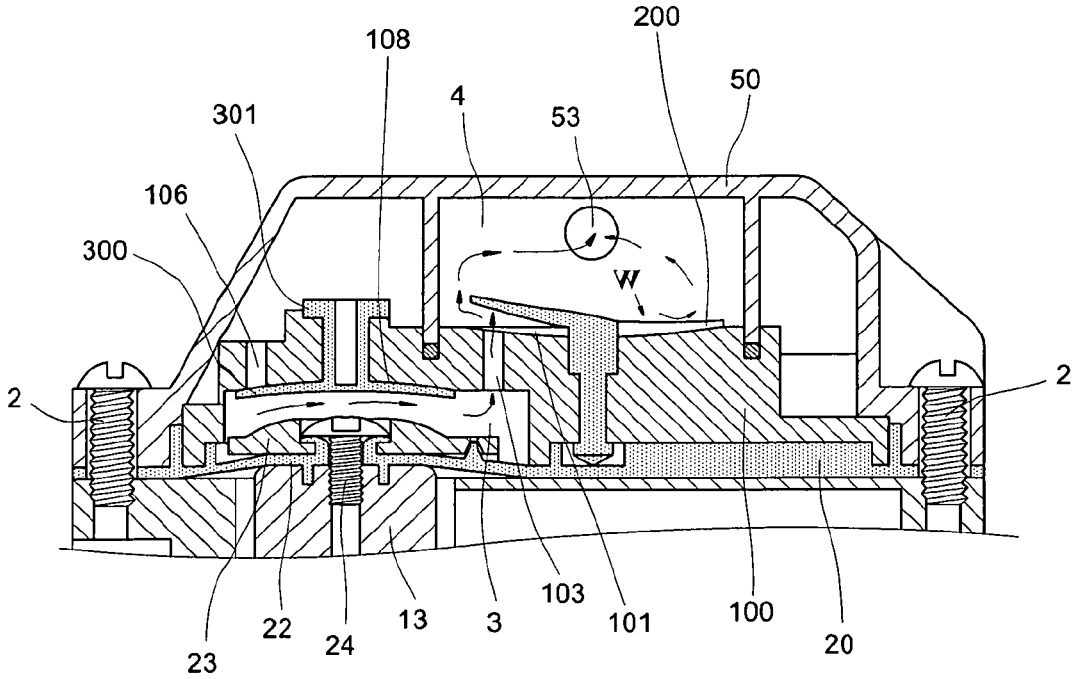
FIG. 18 is an operational view of the FIG. 17.

For assembly and functional operation, please refer to the FIGS. 16 though 18. After properly anchoring the anti-backflow plastic gasket 200 into the water discharge base 101 via inserting the orientating stem 201 into the orientating hole 102, a gap G1 is formed between the bottom surface 203 of the anti-backflow plastic gasket 200 and the camber concave 107 of the water discharge base 101 (as shown in the FIG. 16); Likewise, after properly anchoring each piston slice 300 into each corresponding water inlet port 104 via inserting each orientating stem 301 into each corresponding orientating hole 105, a gap G2 is formed between the bottom surface 303 of the piston slice 300 and the camber concave 108 of the water inlet port 104 (as shown in the FIG. 16). By means of the functions of the gap G1 and gap G2, the overall efficiency of the compressing effect from the preliminary low-pressured chamber 3 and intensive high-pressured chamber 4 can be substantially enhanced because both sucking forces of the anti-backflow plastic gasket 200 and piston slice 300 are increased by the reciprocal actions of the piston pusher 23; Thus, the object of the "improving compressing efficiency" can be easily achieved; Meanwhile, comparing to the hemisphere-shaped bowl of the corresponding conventional anti-backflow plastic gasket 40 and the multi-blade disk-shape of the corresponding conventional anti-backflow plastic gasket 70 as well as flare shape of the corresponding conventional flare piston slice 36, both of the anti-backflow plastic gasket 200 and piston slice 300 are made in plano-convex shape so that not only the durability thereof can be improved but also the effects of hermetical attachment onto the corresponding water discharge holes 103 and water inlet holes 106 can be achieved (as shown in the FIGS. 17 and 18); Thus, the "abnormal pressure" issue in the piston valve 30 of the conventional diaphragm pump 1 is completely solved by the present invention. Moreover, because the anti-backflow plastic gasket 200 of the present is made by unitarily one-piece molding into an integral single unit, the assembly procedure for the present invention is much quicker and much more time-saving than that of the conventional diaphragm pump 1 so that the labor cost in the fabrication can be significantly reduced; Thus, for mass production of the diaphragm pump 1, the present invention offers better competitiveness in the economic effect of the mass production.

Figure 19:
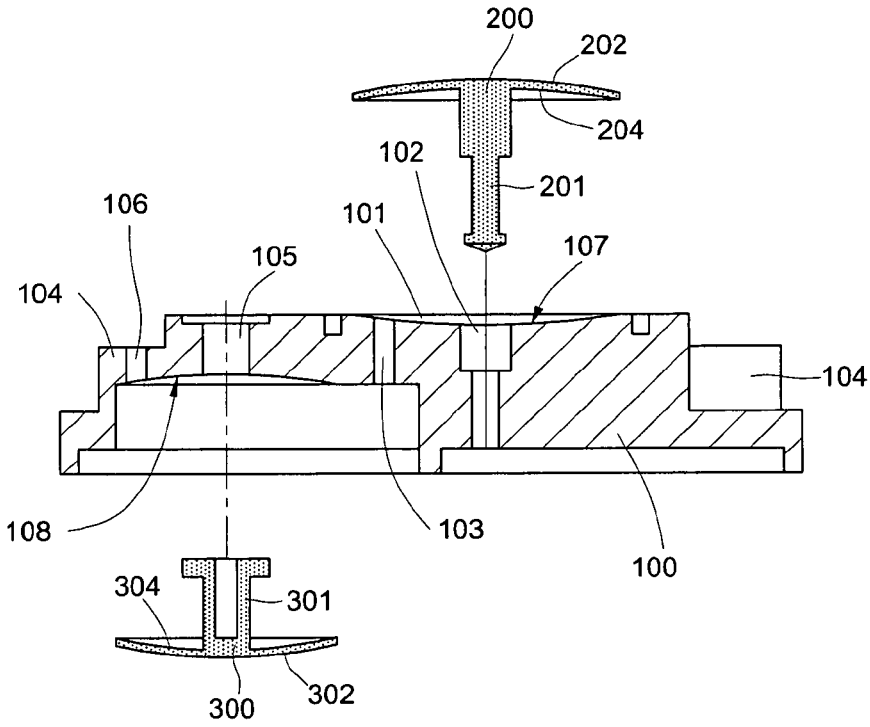
FIG. 19 is an exploded sectional view for another embodiment of the present invention.
Figure 20:
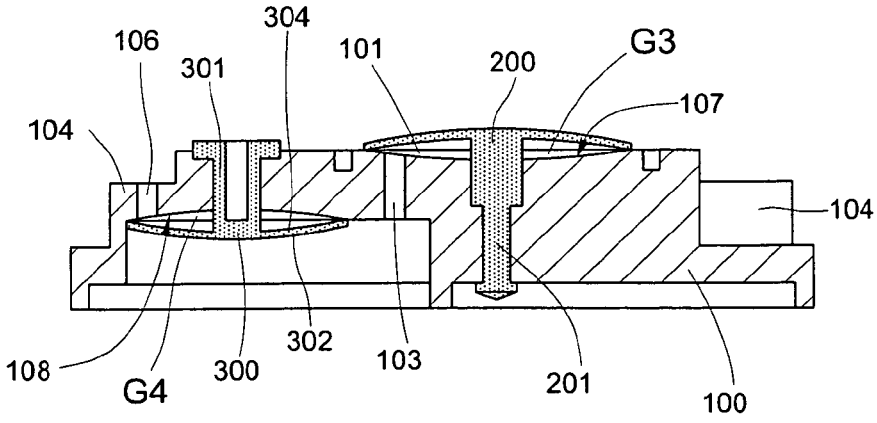
FIG. 20 is an assembly sectional view for another embodiment of the present invention.

Furthermore, as shown in the FIGS. 19 and 20, which shows the other exemplary embodiment of the present invention, wherein the bottom surface of the anti-backflow plastic gasket 200 is configured into a camber concave 204 and the bottom surface of the piston slice 300 is also configured into a camber concave 304 (as shown in the FIG. 19) so that the gap G3 between the camber concave 204 of the anti-backflow plastic gasket 200 and the camber concave 107 of the water discharge base 101 becomes bigger than the gap G1 and the gap G4 between the camber concave 304 of the piston slice 300 and the camber concave 108 of the water inlet holes 106 becomes bigger than the gap G2 (as shown in the FIG. 20); Thus, the overall efficiency of the compressing effect can be more substantially enhanced because both sucking forces of the anti-backflow plastic gasket 200 and piston slice 300 are further increased by the reciprocal actions of the piston pusher 23.

What is claimed is:

1. A piston valve for a diaphragm pump, the valve comprising:

a central water discharge base including an outer top concave surface having an orientating hole at a lowest point of the top concave surface, an anti-backflow gasket formed of plastic material, the gasket including an integral orientating stem, a convex top surface and a bottom surface, the stem being engageable in the orientating hole of the top concave surface to define a gap between the bottom surface of the gasket and the top concave surface of the discharge base such that a thickness measured from a central top point of the gasket to the bottom surface thereof exceeds a thickness measured from a top edge of the gasket to the bottom surface thereof, and a plurality of water inlet ports disposed around the water discharge base, each water inlet port including an outer top concave surface, an orientating hole at a lowest point of the outer top concave surface, a piston slice formed of plastic material, the piston slice including a convex top surface, a bottom surface and an integral orientating stem engageable within the orientating hole to define a gap between the top surface of the piston slice and the top concave surface of the water inlet port such that a thickness measured from a central top point of the piston slice to the bottom surface thereof exceeds a thickness measured from a top edge of the piston slice to the bottom surface thereof.

2. The piston valve of claim 1 wherein the bottom surface of the gasket and the bottom surface of each piston slice is concave.

* * * * *